US009714498B1

(12) United States Patent
Bucher

(10) Patent No.: US 9,714,498 B1
(45) Date of Patent: Jul. 25, 2017

(54) BERM REPAIR ASSEMBLY

(71) Applicant: Kenneth D. Bucher, Monclova, OH (US)

(72) Inventor: Kenneth D. Bucher, Monclova, OH (US)

( * ) Notice: Subject to any disclaimer, the term of this patent is extended or adjusted under 35 U.S.C. 154(b) by 533 days.

(21) Appl. No.: 13/917,236

(22) Filed: Jun. 13, 2013

(51) Int. Cl.
*E02F 3/76* (2006.01)
*E02F 3/627* (2006.01)

(52) U.S. Cl.
CPC ..... *E02F 3/7622* (2013.01); *E02F 3/6276* (2013.01)

(58) Field of Classification Search
CPC .... E02F 3/6276; E02F 3/7622; A01B 59/046; A01B 63/106
USPC ..... 172/445.1, 451, 308
See application file for complete search history.

(56) References Cited

U.S. PATENT DOCUMENTS 1,751,158 A * 3/1930 Jess ..... A01B 17/004 172/202
1,753,022 A * 4/1930 Robbins ..... E02F 3/60 172/26.5
2,280,520 A * 4/1942 Davenport ..... E02F 3/60 172/26.5
2,652,642 A * 9/1953 Gifford ..... E02F 3/7627 172/199
3,845,516 A * 11/1974 Abbott ..... A01K 31/04 119/442
3,908,289 A * 9/1975 Ross ..... E02F 3/7686 172/225
4,109,336 A 8/1978 Ford
4,316,509 A * 2/1982 Hallum ..... A01B 13/16 172/1
4,571,119 A * 2/1986 Jones ..... E01C 19/482 404/103
4,620,381 A * 11/1986 Plyler ..... E02F 3/7663 172/677
4,936,392 A 6/1990 Kitchin
5,542,478 A * 8/1996 Heiple ..... E02F 3/80 172/782
6,467,552 B1 * 10/2002 Whatmough ..... A01B 31/00 172/445.1
D478,097 S 8/2003 Vennard et al.
6,612,774 B1 9/2003 Dulin
6,843,001 B2 * 1/2005 Jenne ..... E02F 3/7618 37/93
6,951,253 B1 * 10/2005 Linsmeier ..... A01K 1/01 172/110
7,510,348 B2 * 3/2009 James ..... E01H 1/003 172/172
7,624,520 B2 * 12/2009 Gordon ..... E02F 3/7609 172/815

(Continued)

*Primary Examiner* — Thomas B Will
*Assistant Examiner* — Joel F. Mitchell

(57) ABSTRACT

A berm repair assembly repairs a berm adjacent to a roadway. The assembly includes a hitch configured for coupling to a vehicle. An elongated frame has a main section coupled to the hitch. A triangular first outer section of the frame is coupled to and extends from the main section of the frame terminating at a first end of the frame. The first end of the frame is positioned in laterally spaced relationship to the hitch. A leveler is coupled to the first outer section of the frame. The leveler has a substantially V-shaped medial section and a pair of spaced opposed side walls. Each side wall extends from an associated end of the medial section.

9 Claims, 5 Drawing Sheets

(56) References Cited

U.S. PATENT DOCUMENTS

| | | | | |
|---|---|---|---|---|
| 8,297,879 | B1 * | 10/2012 | Schmidt | E01H 1/003<br>172/811 |
| 2007/0137872 | A1 | 6/2007 | Ziebell | |
| 2008/0298892 | A1 | 12/2008 | Megli et al. | |

* cited by examiner

BERM REPAIR ASSEMBLY

BACKGROUND OF THE DISCLOSURE

Field of the Disclosure

The disclosure relates to road repair devices and more particularly pertains to a new road repair device for repairing a berm adjacent to a roadway.

SUMMARY OF THE DISCLOSURE

An embodiment of the disclosure meets the needs presented above by generally comprising a hitch configured for coupling to a vehicle. An elongated frame has a main section coupled to the hitch. A triangular first outer section of the frame is coupled to and extends from the main section of the frame terminating at a first end of the frame. The first end of the frame is positioned in laterally spaced relationship to the hitch. A leveler is coupled to the first outer section of the frame. The leveler has a substantially V-shaped medial section and a pair of spaced opposed side walls. Each side wall extends from an associated end of the medial section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
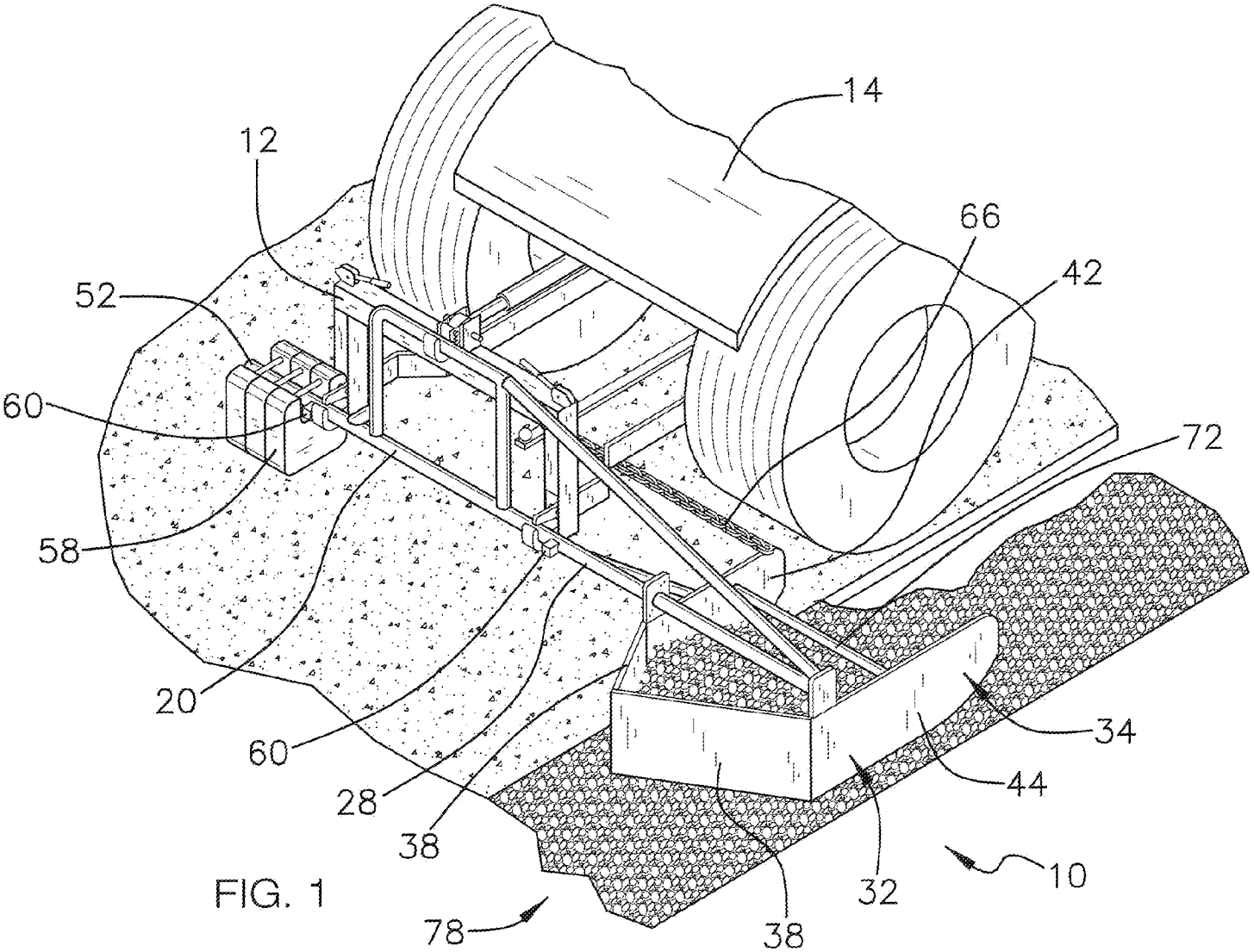
FIG. 1 is a top rear side perspective view of a berm repair assembly according to an embodiment of the disclosure.
Figure 2:
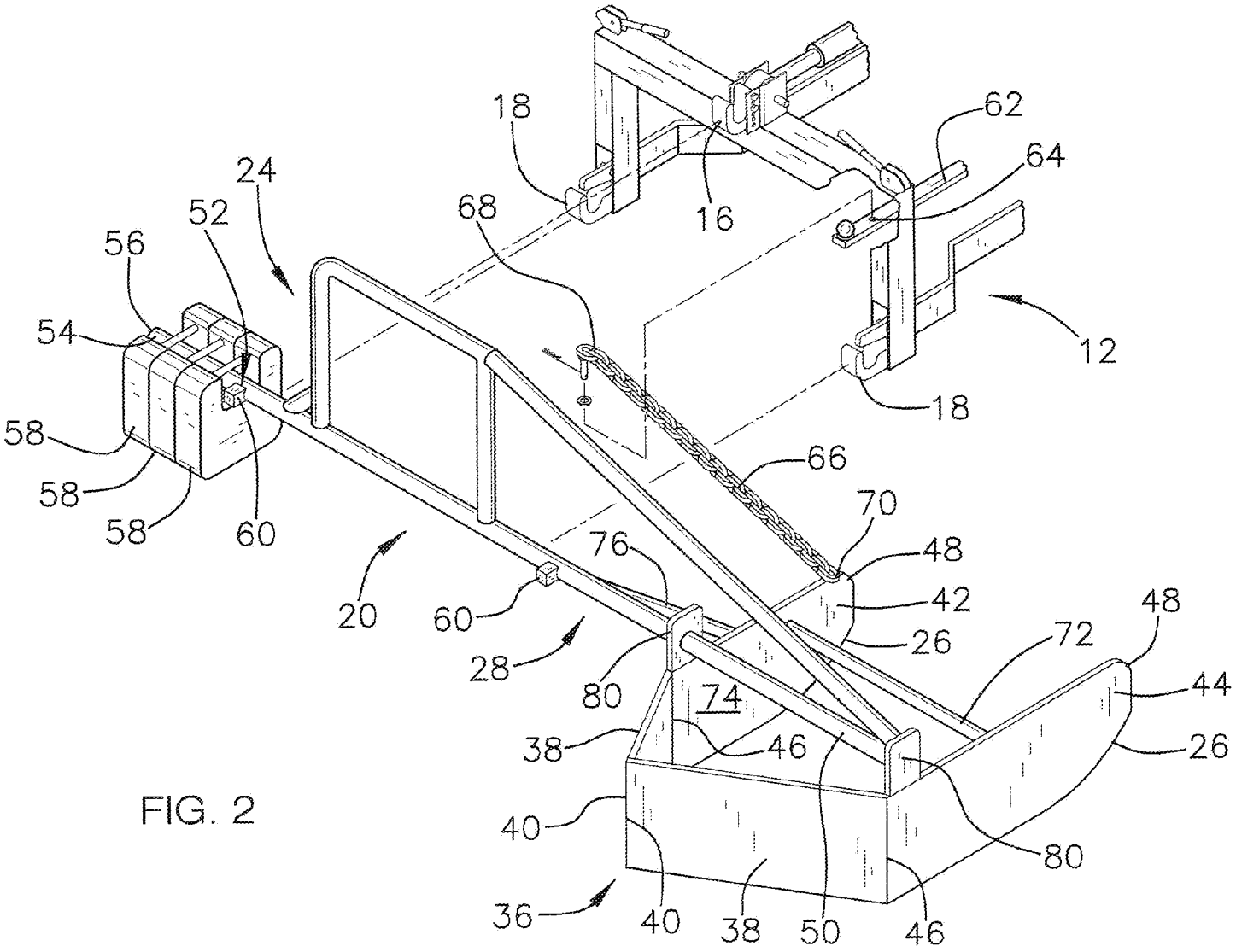
FIG. 2 is a top rear side perspective view of an embodiment of the disclosure.
Figure 3:
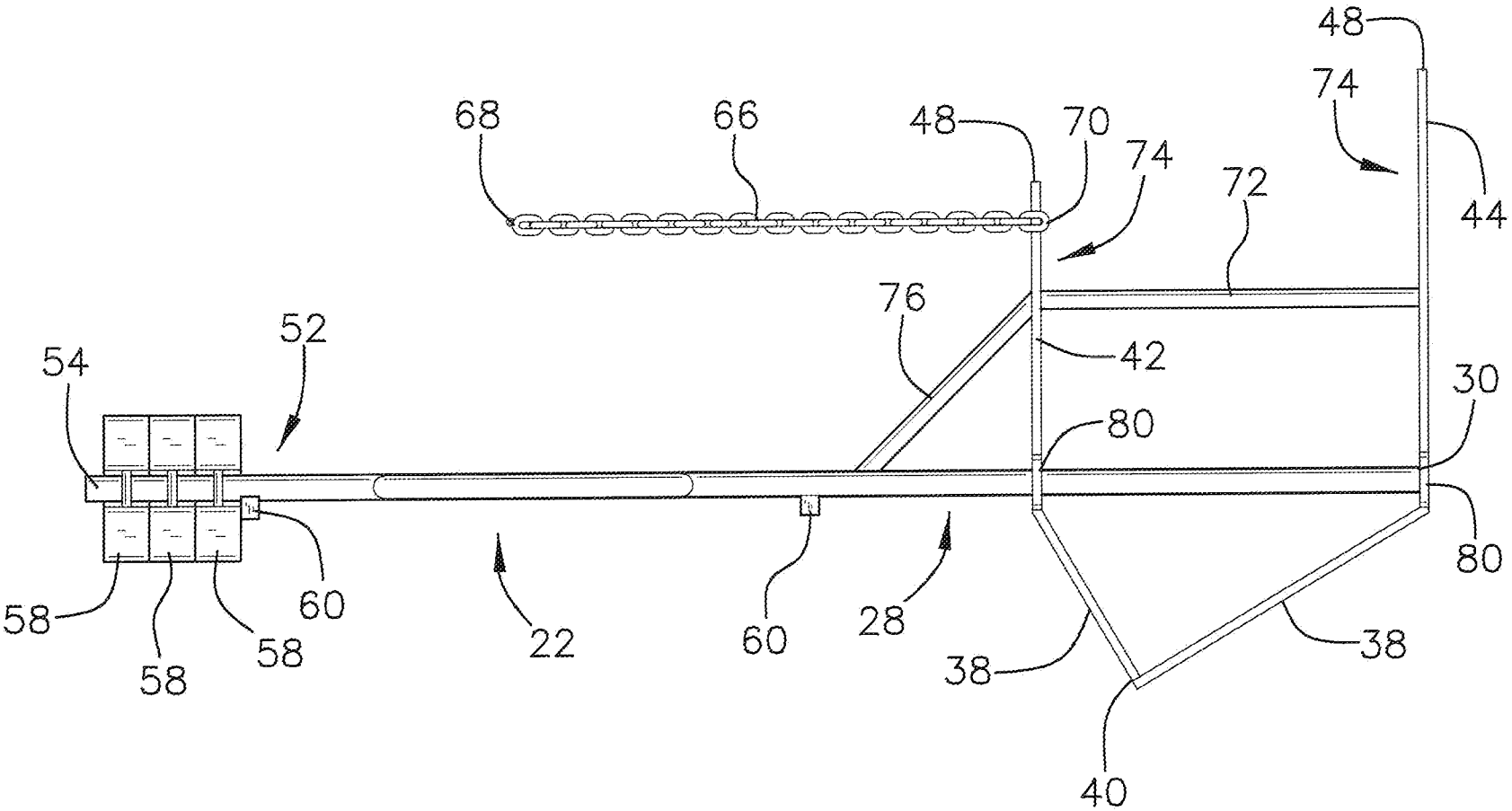
FIG. 3 is a top view of an embodiment of the disclosure.
Figure 4:
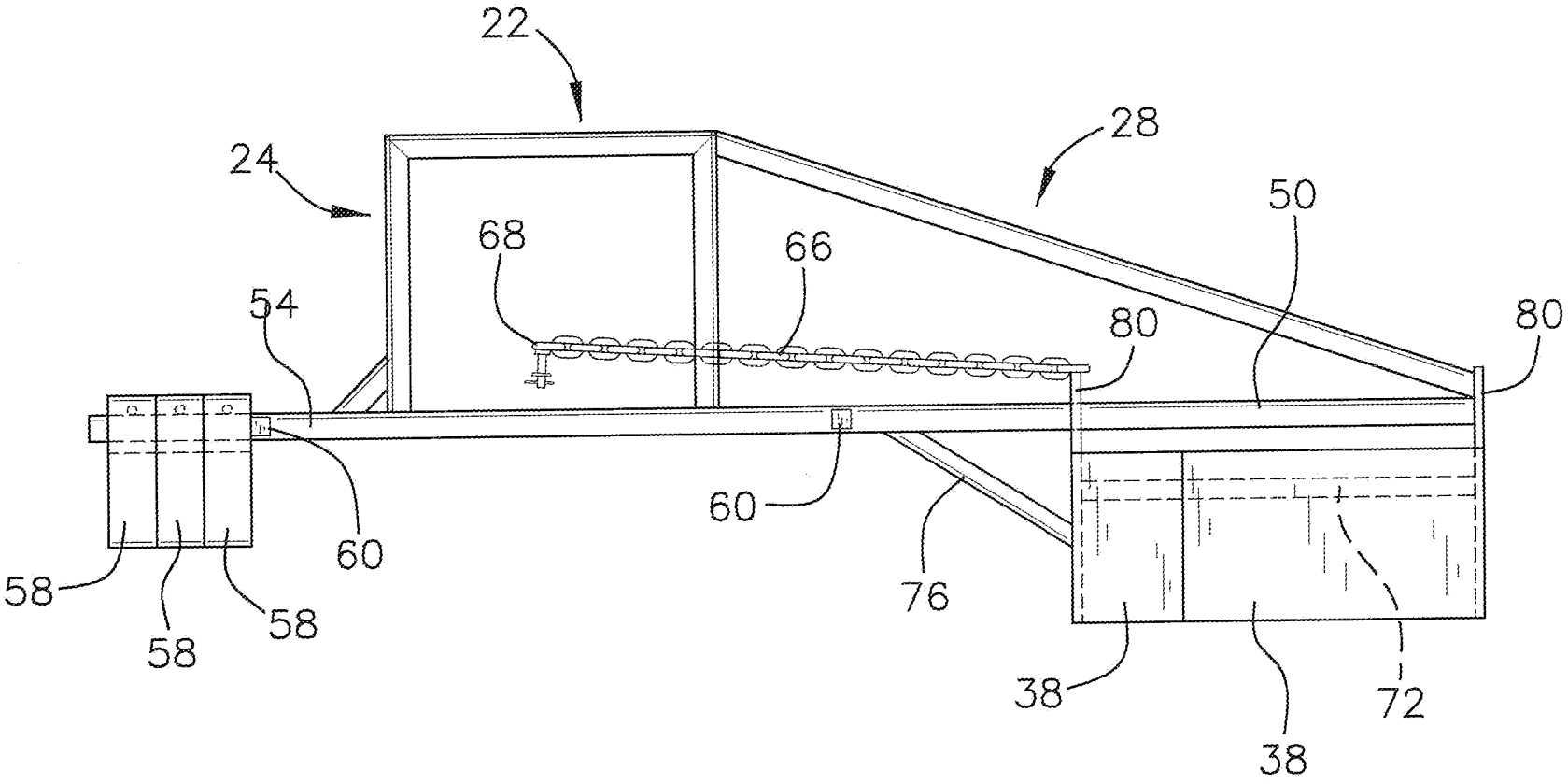
FIG. 4 is a front view of an embodiment of the disclosure.
Figure 5:
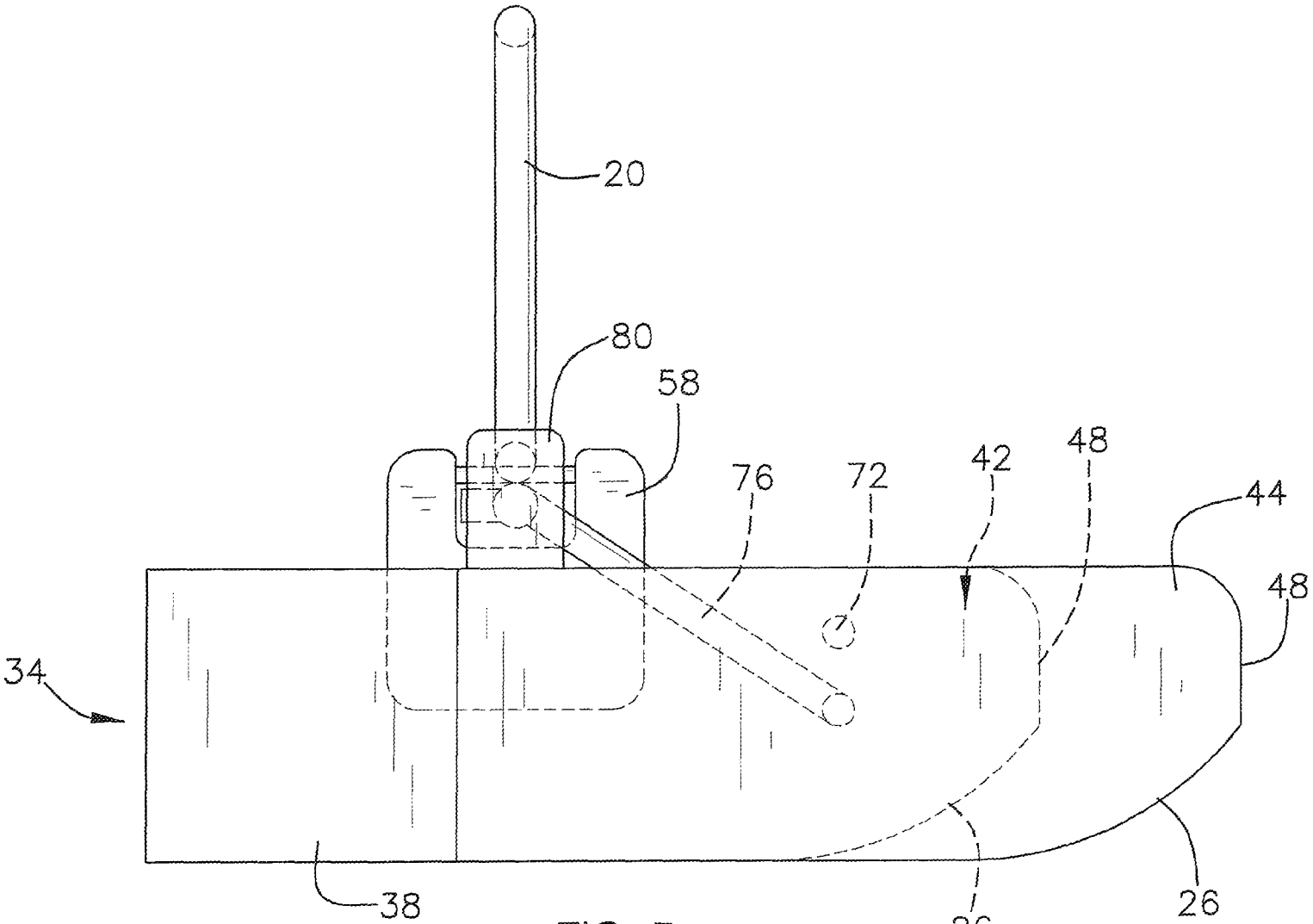
FIG. 5 is a side view of an embodiment of the disclosure.

With reference now to the drawings, and in particular to FIGS. 1 through 5 thereof, a new road repair device embodying the principles and concepts of an embodiment of the disclosure and generally designated by the reference numeral 10 will be described.

As best illustrated in FIGS. 1 through 5, the berm repair assembly 10 generally comprises a hitch 12 configured for coupling to a vehicle 14. The hitch 12 may be a three point hitch having an upper coupler 16 and a pair of spaced lower couplers 18. An elongated frame 20 has a main section 22 coupled to the hitch 12. The main section 22 may comprise a rectangular arrangement of bars 24. A triangular first outer section 28 is coupled to and extends from the main section 24 of the frame 20. The first outer section 28 terminates at a first end 30 of the frame 20. The first end 30 of the frame 20 is positioned in laterally spaced relationship to the hitch 12 and the frame is sufficient in length to position the first end 30 of the frame 20 in a laterally extended position 32 from the vehicle 14. A leveler 34 is coupled to the first outer section 28 of the frame 20. The leveler 34 has a substantially V-shaped medial section 36 formed by planar panels 38 joined along adjacent sides 40. The panels 38 may be angled such that the junction of the adjacent sides 40 is offset from a center of the leveler 34 towards the hitch 12. The leveler 34 further has a pair of spaced opposed side walls 42,44. Each side wall 42,44 extends from an associated end 46 of the medial section 36. A proximal one of the side walls 42 relative to the hitch 12 is shorter than a distal one of the side walls 44 relative to the hitch 12. A leading bottom edge 26 of each side wall 42,44 may be straight and angled relative to a horizontal plane to prevent snagging of a forward end 48 of each side wall 42,44 as the assembly 10 is used. The frame 20 is elongated such that the leveler 34 is offset laterally from the vehicle 14. A pair of connection plates 80 is coupled to and extends upwardly from the leveler 34. The first outer section 28 of the frame 20 has a lower bar 50 coupled to and extending through the connection plates 80 wherein the leveler 34 is coupled to the frame 20.

A second outer section 52 of the frame 20 is coupled to and extends from the main section 22 of the frame 20. The second outer section 52 may comprise a single elongated bar 54 terminating at a second end 56 of the frame 20 extending laterally from the hitch 12 in a direction opposite the first end 30 of the frame 20. A counterweight 58 may be coupled to the second outer section 52 of the frame 20 between the second end 56 of the frame 20 and the main section 22 of the frame 20. The counterweight 58 may be a single unit or multiple weights each being selectively coupled to the second outer section 52. Hitch stoppers 60 may be coupled to the frame 20 to inhibit lateral movement of the frame 20 relative to the hitch 12. A ball hitch arm 62 may also be coupled to and extend from the hitch 12. A hole 64 extends through the ball hitch arm 62 positioned between the hitch 12 and the frame 20. A chain 66 has a first end 68 and a second end 70. The first end 68 of the chain 66 may be coupled to the hitch 12 by connection to the hole 64 in the ball hitch arm 62. The second end 70 of the chain 66 is coupled to the leveler 34 on the proximal side wall 42 such that the chain extends parallel to the frame 20. A brace 72 may be coupled to and extend between opposed faces 74 of the opposite side walls 42,44 of the leveler 34. A gusset 76 may also be coupled to and extend between the proximal side wall 42 and the frame 20 to stabilize the leveler 34 relative to the frame 20.

In use, the assembly 10 is coupled to the vehicle 14 using the hitch 12. The vehicle 14 may then be driven on a roadway with the leveler 34 extending out from the vehicle 14 such that the leveler 34 passes over and levels a berm 78 adjacent to the roadway.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A berm repair assembly comprising:

a hitch configured for coupling to a vehicle;

an elongated frame, said frame having a main section coupled to said hitch, a triangular first outer section being coupled to and extending from said main section of said frame, said first outer section terminating at a first end of said frame, said first end of said frame being positioned in laterally spaced relationship to said hitch;

a leveler coupled to said first outer section, said leveler having a substantially V-shaped medial section and a pair of spaced opposed side walls, each said side wall extending from an associated end of said medial section;

a second outer section being coupled to and extending from said main section of said frame, said second outer section terminating at a second end of said frame extending laterally from said hitch opposite said first end of said frame; and a counterweight coupled to said second outer section between said second end of said frame and said main section of said frame.

2. The assembly of claim 1, further comprising a pair of connection plates coupled to and extending upwardly from said leveler, said first outer section having a lower bar coupled to and extending through said connection plates wherein said leveler is coupled to said frame.

3. The assembly of claim 1, further comprising said hitch being a three point hitch having an upper coupler and a pair of spaced lower couplers.

4. The assembly of claim 1, further comprising a ball hitch arm coupled to and extending from said hitch.

5. The assembly of claim 4, further comprising a hole extending through said ball hitch arm.

6. The assembly of claim 1, further comprising a brace coupled to and extending between opposed faces of said opposite side walls of said leveler.

7. The assembly of claim 1, further comprising a proximal one of said side walls relative to said hitch being shorter than a distal one of said side walls relative to said hitch.

8. The assembly of claim 1, further comprising a chain having a first end and a second end, said first end of said chain being coupled to said hitch, said second end of said chain being coupled to said leveler.

9. A berm repair assembly comprising:

a hitch configured for coupling to a vehicle, said hitch being a three point hitch having an upper coupler and a pair of spaced lower couplers;

an elongated frame, said frame having a main section coupled to said hitch, a triangular first outer section being coupled to and extending from said main section of said frame, said first outer section terminating at a first end of said frame, said first end of said frame being positioned in laterally spaced relationship to said hitch;

a leveler coupled to said first outer section, said leveler having a substantially V-shaped medial section and a pair of spaced opposed side walls, each said side wall extending from an associated end of said medial section, a proximal one of said side walls relative to said hitch being shorter than a distal one of said side walls relative to said hitch;

a pair of connection plates coupled to and extending upwardly from said leveler, said first outer section having a lower bar coupled to and extending through said connection plates wherein said leveler is coupled to said frame;

a second outer section being coupled to and extending from said main section of said frame, said second outer section terminating at a second end of said frame extending laterally from said hitch opposite said first end of said frame;

a counterweight coupled to said second outer section between said second end of said frame and said main section of said frame;

a ball hitch arm coupled to and extending from said hitch;

a hole extending through said ball hitch arm;

a brace coupled to and extending between opposed faces of said opposite side walls of said leveler; and a chain having a first end and a second end, said first end of said chain being coupled to said hitch, said second end of said chain being coupled to said leveler.

* * * * *